US005159353A

United States Patent [19]

Fasen et al.

[11] Patent Number: 5,159,353

[45] Date of Patent: Oct. 27, 1992

[54] THERMAL INKJET PRINTHEAD STRUCTURE AND METHOD FOR MAKING THE SAME

[75] Inventors: Duane A. Fasen; Jerome E. Beckmann, both of Loveland; John H. Stanback, Fort Collins, all of Colo.; Ulrich E. Hess, Corvallis, Oreg.; James R. Hulings, Fort Collins, Colo.; Larry S. Metz, Fort Collins, Colo.; Charles E. Moore, Loveland, Colo.

[73] Assignee: Hewlett-Packard Company, Palo Alto, Calif.

[21] Appl. No.: 724,658

[22] Filed: Jul. 2, 1991

[51] Int. Cl.[5] ..... B41J 2/05

[52] U.S. Cl. ..... 346/140 R; 29/890.1; 437/42

[58] Field of Search ..... 346/140 R; 437/42, 41; 29/890.1

[56] References Cited

U.S. PATENT DOCUMENTS

| | | | |
|---|---|---|---|
| 3,852,563 | 12/1974 | Bohorquez et al. . | |
| 4,424,461 | 1/1984 | Taguchi et al. . | |
| 4,466,172 | 8/1984 | Batra | 437/42 X |
| 4,500,895 | 2/1985 | Buck et al. | 346/140 R |
| 4,510,670 | 4/1985 | Schwabe et al. . | |
| 4,513,298 | 4/1985 | Scheu . | |
| 4,532,530 | 7/1985 | Hawkins . | |
| 4,695,853 | 9/1987 | Hackleman et al. . | |
| 4,719,477 | 1/1988 | Hess | 346/140 R |
| 4,794,409 | 12/1988 | Cowger et al. | 346/140 R |
| 4,853,718 | 8/1989 | ElHatem et al. . | |
| 4,875,968 | 10/1989 | O'Neill et al. . | |
| 4,899,180 | 2/1990 | ElHatem et al. . | |
| 4,947,192 | 8/1990 | Hawkins et al. | 346/140 R |
| 5,075,250 | 12/1991 | Hawkins | 437/52 |

OTHER PUBLICATIONS

Appels, J. A. et al., "Local Oxidation of Silicon; New Technological Aspects," *Philips Research Reports*, vol. 26, No. 3, pp. 157–165 (Jun. 1971).

Kooi, E. et al., "Locos Devices," *Philips Research Reports*, vol. 26, No. 3, pp. 166–180 (Jun. 1971).

"The Hewlett-Packard Journal", vol. 36, No. 5 (May 1985).

*The Hewlett-Packard Journal*, vol. 39, No. 4 (Aug. 1988).

Elliot, D. J., *Integrated Circuit Fabrication Technology*, McGraw-Hill Book Company, New York, NY (1982), pp. 1–41.

Computer patent search printouts.

*Primary Examiner*—Joseph W. Hartary

[57] ABSTRACT

An improved thermal inkjet printhead having MOSFET drive transistors incorporated therein. The gate of each MOSFET transistor is formed by applying a layer of silicon dioxide onto a silicon substrate, applying a layer of silicon nitride onto the silicon dioxide, and applying a layer of polycrystalline silicon onto the silicon nitride. Portions of the substrate surrounding the gate are oxidized, forming field oxide regions. Drain and source regions are then conventionally formed, followed by the application of a protective dielectric layer onto the field oxide, drain, source, and gate. A resistive layer is deposited on the dielectric layer and directly connected to the source, drain, and gate. A conductive layer is deposited on a portion of the resistive layer, ultimately forming both covered and uncovered regions thereof. The uncovered region functions as a heating resistor, and the covered regions function as electrical contacts to the transistor and resistor.

37 Claims, 4 Drawing Sheets

THERMAL INKJET PRINTHEAD STRUCTURE AND METHOD FOR MAKING THE SAME

BACKGROUND OF THE INVENTION

The present invention generally relates to a thermal inkjet printhead of improved design, and more particularly to an improved printhead and method for making the same which involves the integration of MOSFET drive transistor circuitry directly within the printhead structure.

A substantial demand exists for printing systems of high efficiency and resolution. To satisfy this demand, thermal inkjet cartridges have been developed which print in a rapid and efficient manner. These cartridges include an ink reservoir in fluid communication with a substrate having a plurality of resistors thereon. Selective activation of the resistors causes thermal excitation of the ink and expulsion thereof from the cartridge. Representative thermal inkjet systems are discussed in U.S. Pat. No. 4,500,895 to Buck et al.; No. 4,513,298 to Scheu; No. 4,794,409 to Cowger et al.; the *Hewlett-Packard Journal.* Vol. 36, No. 5 (May 1985); and the *Hewlett-Packard Journal,* Vol. 39, No. 4 (August 1988), all of which are incorporated herein by reference.

In recent years, research has been conducted in order to increase the degree of print resolution and quality of thermal inkjet printing systems. Print resolution necessarily depends on the number of printing resistors formed on the cartridge substrate. Modern circuit fabrication techniques allow the placement of substantial quantities of resistors on a single printhead substrate. However, the number of resistors applied to the substrate is limited by the conductive components used to electrically connect the cartridge to external pulse driver circuitry in the printer unit. Specifically, an increasingly large number of resistors requires a correspondingly large number of interconnection pads, leads, and the like. This causes greater manufacturing/production costs, and increases the probability that defects will occur during the manufacturing process.

In order to solve this problem, thermal inkjet printheads have been developed which incorporate pulse driver circuitry (e.g. metal oxide semiconductor field effect (MOSFET) transistors) directly on the printhead substrate with the resistors. This development is described in U.S. Pat. Nos. 4,719,477 to Hess; 4,532,530 to Hawkins; and 4,947,192 to Hawkins. The incorporation of driver circuitry on the printhead substrate in this manner reduces the number of interconnect components needed to electrically connect the cartridge to the printer unit. This results in an improved degree of production and operating efficiency.

To produce high-efficiency, integrated printing systems as described above, significant research activities have been conducted in order to develop improved MOSFET transistor structures and methods for integrating the same into thermal inkjet printing units. Currently, MOSFET devices are manufactured using a substantial number of conventional masking/etching steps, as described in Appels, J. A. et al., "Local Oxidation of Silicon; New Technological Aspects," *Philips Research Reports,* Vol. 26, No. 3, pp. 157–165 (June 1971); Kooi, E., et al., "Locos Devices," *Philips Research Reports,* Vol. 26, No. 3, pp. 166–180 (June 1971); U.S. Pat. No. 4,510,670 to Schwabe; and Elliott, D. J., Integrated *Circuit Fabrication Technology,* McGraw-Hill Book Company, New York, 1982 (ISBN No. 0-07-019238-3), all of which are incorporated herein by reference. However, it is always desirable in the production of MOSFET devices and thermal inkjet printing systems to reduce the number of necessary materials and manufacturing steps. This results in lower production costs and greater manufacturing efficiency.

The present invention represents an improved MOSFET transistor structure integrated into a thermal inkjet printing system. The integrated thermal inkjet printhead produced in accordance with the invention is highly efficient, economical, and represents an advance in the art of printing technology, as described herein.

SUMMARY OF THE INVENTION

It is an object of the present invention to provide an improved thermal inkjet printhead structure and method for making the same.

It is another object of the invention to provide an improved thermal inkjet printhead structure having MOSFET driver circuitry integrated therein.

It is another object of the invention to provide a method for making an improved thermal inkjet printhead structure having MOSFET driver circuitry therein which uses a reduced number of processing steps compared with previously-known production procedures.

In accordance with the foregoing objects, the present invention involves an improved MOSFET transistor structure and method for making the same. The invention also involves an improved thermal inkjet printhead and manufacturing process in which MOSFET devices are directly integrated into the printhead structure. Specifically, a MOSFET device of the present invention is produced by first providing a silicon substrate. A layer of silicon dioxide is then formed on the substrate, followed by the application of a layer of silicon nitride thereon in order to form a dual-layer structure. The foregoing layer of silicon dioxide in the dual layer structure will function as gate oxide in the completed MOSFET device. Next, selected portions of the silicon nitride layer are removed in order to form a dual layer structure of reduced size surrounded by exposed silicon dioxide regions. The exposed silicon dioxide regions are subsequently subjected to additional oxidation in order to form thick silicon dioxide field oxide regions having unoxidized silicon thereunder. A layer of polycrystalline silicon is then applied to the field oxide regions and the remaining silicon nitride section in the dual layer structure. Thereafter, the layer of polycrystalline silicon is etched so that only a selected portion of the remaining silicon nitride section is covered by polycrystalline silicon. In a preferred embodiment, the polycrystalline silicon is isotropically etched so that the width of the polycrystalline silicon layer on top of the silicon nitride section decreases continuously from the bottom of the section to the top thereof. The resulting structure has downwardly-sloped side edges. Thereafter, the portions of the dual layer structure which extend outwardly beyond the remaining section of polycrystalline silicon are removed in order to produce the gate to be used in the MOSFET device. After gate formation, source and drain regions are conventionally created in order to complete the MOSFET device. The manufacturing sequence described above in which the initial layers of silicon dioxide and silicon nitride are allowed to remain intact eliminates a number of etching and deposition steps required in previous processes, as described in greater detail herein.

To produce a thermal inkjet printhead in accordance with the invention, a layer of dielectric material (e.g. silicon nitride) is applied to the field oxide regions and the MOSFET device. Thereafter a layer of resistive material is applied to the dielectric layer. Prior to the application of resistive material, the dielectric layer is conventionally removed from a portion of the gate, source region, and drain region so that the layer of resistive material can make direct electrical contact therewith. The layer of resistive material preferably consists of a composition selected from the group consisting of polycrystalline silicon, a co-sputtered mixture of tantalum and aluminum, and tantalum nitride. A layer of conductive material (e.g. aluminum, gold, or copper) is positioned on the layer of resistive material and thereafter selectively removed in order to form covered sections of the resistive material and uncovered sections thereof. The uncovered sections ultimately function as heating resistors in the printhead. The covered sections are used to form continuous conductive links between the gate, source region, and drain region of the MOSFET device and other components in the printing system (e.g. the heating resistors). Thus, the dual layer of resistive material/conductive material performs multiple functions: (1) as heating resistors in the system, and (2) as direct conductive pathways to the MOSFET devices on the printhead. A selected portion of protective material is then applied to the covered and uncovered sections of resistive material. Thereafter, an orifice plate member having a plurality of openings therethrough is positioned on the protective material. Beneath each of the openings, a section of the protective material is removed in order to form an ink-receiving cavity thereunder. Positioned below each cavity is one of the heating resistors. The activation of each resistor by its associated transistor causes the resistor to heat the cavity above it, expelling ink therefrom.

These and other objects, features, and advantages of the present invention shall be described below in the following Brief Description of the Drawings and Detailed Description of Preferred Embodiments.

BRIEF DESCRIPTION OF THE DRAWINGS

Illustrative and presently preferred embodiments of the invention are shown in the accompanying drawings in which.

DETAILED DESCRIPTION OF PREFERRED EMBODIMENTS

The present invention involves an improved thermal inkjet printhead and method for making the same. The printhead specifically includes MOSFET drive transistor devices integrated directly within the printhead structure.

Figure 2:
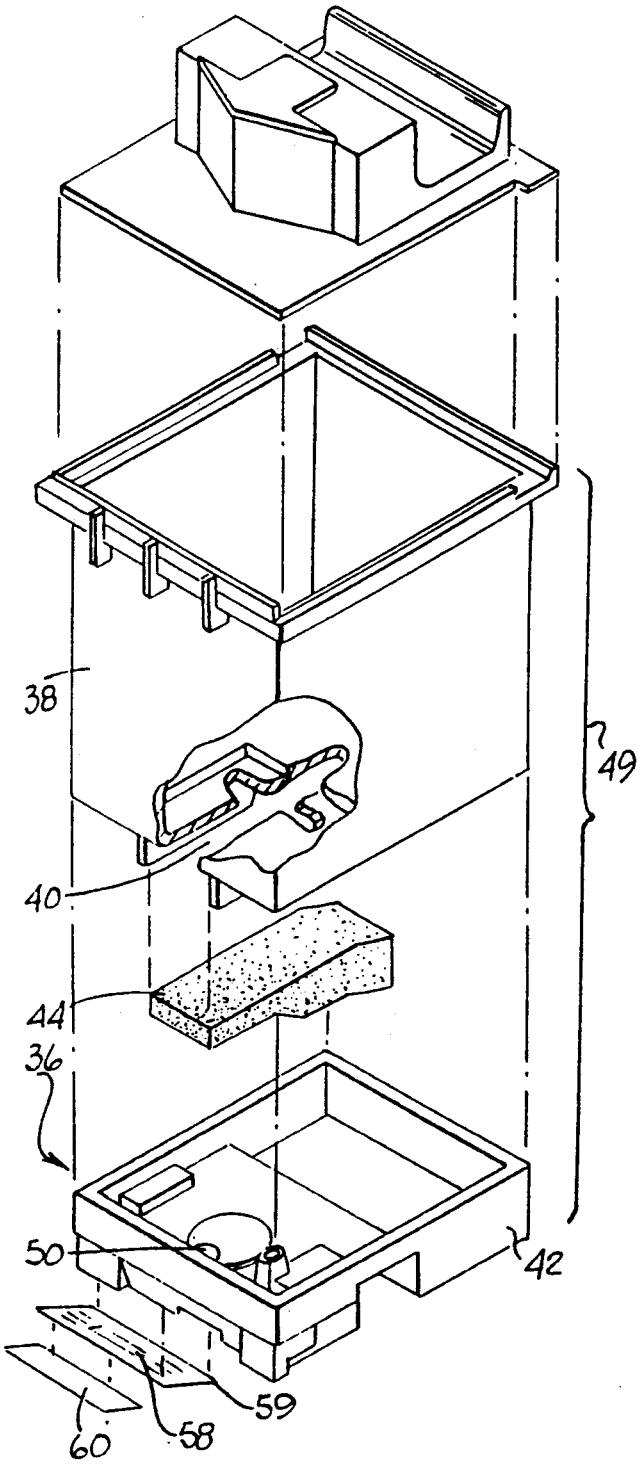
FIG. 2 is a partially exploded perspective view of an alternative thermal inkjet cartridge in which the present invention may be used.
Figure 1:
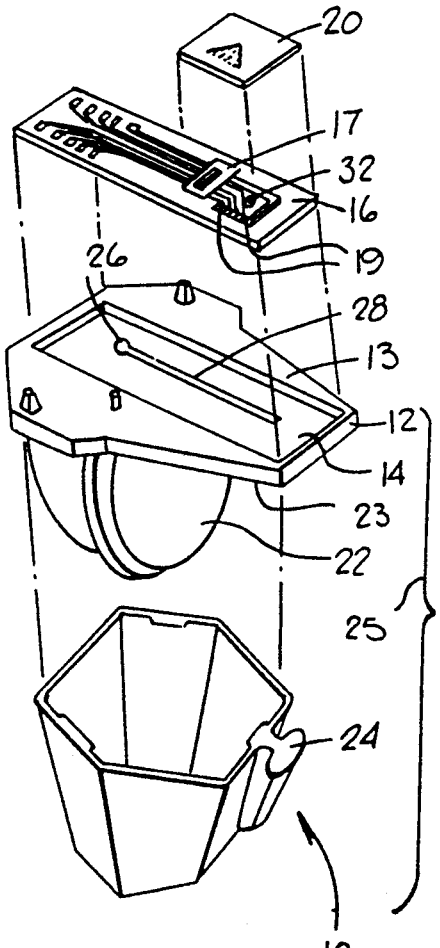
FIG. 1 is a partially exploded perspective view of a representative thermal inkjet cartridge in which the present invention may be used.

The printhead of the present invention is designed to be used in a thermal inkjet printing cartridge system. With reference to FIGS. 1–2, exemplary thermal inkjet cartridges are illustrated which are suitable for use with the present invention. However, the invention is prospectively applicable to other thermal inkjet printing systems, and shall not be limited to incorporation within the cartridges of FIGS. 1–2.

With continued reference to FIG. 1, a cartridge 10 is shown which includes a backing plate 12 having an outer face 13 with a recess 14 therein. Secured within the recess 14 is a substrate 16. The substrate 16 may be configured as desired to include both pulse driver circuitry 17 and heating resistors 19 thereon as schematically illustrated in FIG. 1 and discussed in U.S. Pat. No. 4,719,477 to Hess. Positioned on the substrate 16 is an orifice plate 20 through which ink is ultimately ejected. The cartridge 10 further includes ink-retaining/storage means in the form of a flexible bladder unit 22 which is fixedly secured to the inner face 23 of the backing plate 12. The bladder unit 22 is positioned within a protective cover member 24 which is secured to the backing plate 12. Accordingly, the backing plate 12 and the cover member 24 combine to form a housing 25 designed to retain the bladder unit 22 therein. An outlet 26 is provided through the backing plate 12 which allows communication with the interior of the bladder unit 22. Thereafter, the ink flows through channel 28 and passes into an opening 32 through the substrate 16 where it is subsequently dispensed. Further structural details regarding cartridge 10, as well as the operational characteristics thereof are described in U.S. Pat. No. 4,500,895 to Buck et al. which, along with U.S. Pat. No. 4,719,477 to Hess, is incorporated herein by reference. Cartridge 10 is currently being manufactured and sold by the Hewlett-Packard Company of Palo Alto, Calif., under the THINKJET trademark.

In FIG. 2, an additional exemplary cartridge 36 with which the present invention may be used is illustrated. Cartridge 36 includes a reservoir 38 having an opening 40 in the bottom thereof. Also included is a lower portion 42 sized to receive ink-retaining/storage means in the form of a porous sponge-like member 44. The reservoir 38 and the lower portion 42 attach together to form a housing 49 in which the sponge-like member 44 is positioned. Ink from the reservoir 38 flows through opening 40 into the porous sponge-like member 44. Thereafter, during printer operation, ink flows from the sponge-like member 44 through an outlet 50 in the lower portion 42. The ink then passes through an additional opening 58 in a substrate 59 which may include pulse drive circuitry and heating resistors (not shown) thereon in accordance with U.S. Pat. Nos. 4,719,477; 4,532,530; and 4,947,192. The cartridge 36 further includes an orifice plate 60 through which the ink passes during printer operation. Additional details and operational characteristics of the cartridge 36 are discussed in U.S. Pat. No. 4,794,409 to Cowger, et al. which is incorporated herein by reference. Cartridge 36 is currently being manufactured and sold by the Hewlett-Packard Company of Palo Alto, Calif., under the DESKJET trademark. Furthermore, the general construction and operation of thermal inkjet systems are described in the *Hewlett-Packard Journal*, Vol. 36, No. 5 (May 1985) and the *Hewlett-Packard Journal*, Vol. 39, No. 4 (August 1988), both of which are also incorporated herein by reference.

As previously indicated, enhanced print resolution is an important goal in the design of thermal inkjet printing systems. Normally, this goal is accomplished through the use of increased numbers of heating resistors. Modern circuit fabrication techniques enable substantial amounts of resistors to be fabricated on printer substrates. However, physical limitations exist with respect to the conductive connection circuitry used to connect the resistors to pulse driver circuitry in the printer unit as noted above. To solve this problem, it is advantageous to incorporate pulse driver circuitry (e.g. MOSFET transistors) directly onto the printhead substrate as noted above. This configuration substantially reduces the number of connective components necessary for cartridge operation. Nonetheless, the integration of both heating resistors and MOSFET driver transistors onto a common substrate typically results in a structure having a substantial number of individual material layers. These numerous layers cause a direct increase in production and material costs.

Accordingly, the present invention involves a special arrangement of components which enables the production of an integrated printhead structure using a substantially reduced number of production steps/materials. The invention therefore represents an advance in the art of thermal inkjet printhead design, as described in detail below.

Figure 3:
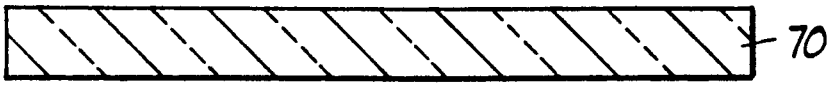
FIGS. 3–19 involve enlarged, cross-sectional schematic views of the materials and sequential production steps used to produce a thermal inkjet printhead in accordance with the present invention, with the completed product being schematically illustrated in FIG. 19.
Figure 4:
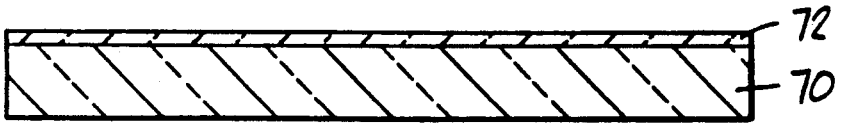
Figure 5:
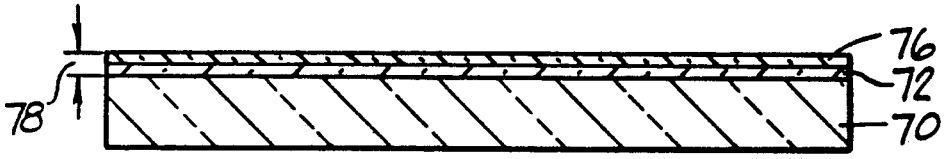

FIGS. 3–19 schematically illustrate the construction of a thermal inkjet printhead structure having integrated pulse driver circuitry thereon in accordance with the present invention. With reference to FIG. 3, a substrate 70 preferably manufactured of p-type (e.g. boron-doped) monocrystalline silicon (about 0.44–0.66 ohm-cm) is first provided having a thickness of about 510–540 microns (about 525 microns=optimum). Next, as shown in FIG. 4, a layer 72 of silicon dioxide is formed on the substrate 70, preferably by the thermal oxidation thereof. Specifically, the substrate 70 may be thermally oxidized to form the layer 72 by heating the substrate 70 at a temperature of about 850 degrees C. for about 5.0 minutes in an $O_2/H_2+O_2$ atmosphere until the for about 30.0 minutes in an $N_2$ atmosphere until the desired thickness of silicon dioxide is formed. Thermal oxidation processes and other basic layer formation techniques described herein, including chemical vapor deposition (CVD), plasma-enhanced chemical vapor deposition (PECVD), low-pressure chemical vapor deposition (LPCVD), and masking/imaging processes used for layer definition are well known in the art and described in U.S. Pat. No. 4,513,298 to Scheu; and Elliott, D. J., *Integrated Circuit Fabrication Technology*, McGraw-Hill Book Company, New York, 1982 (ISBN No. 0-07-019238-3), which are incorporated herein by reference as noted above. In a preferred embodiment, the layer 72 of silicon dioxide will have a thickness of about 200–240 angstroms (about 220 angstroms=optimum). Ultimately, the layer 72 of silicon dioxide will function as gate oxide in the completed MOSFET transistor device within the printhead, as described below.

Next, a layer 76 of silicon nitride (FIG. 5) is applied to the surface of the layer 72 of silicon dioxide by LPCVD preferably resulting from the decomposition of silane mixed with ammonia at a pressure of about 2 torr and temperature of about 300–400 degrees C. As result, a silicon-based dual-layer structure 78 will be formed from the combined layers 72, 76. As described herein below, the dual-layer structure performs a unique multiple function, namely, (1) as a mask in the subsequent production of field oxide regions, and (2) as a composite dielectric structure in the completed gate of the MOSFET device.

In a preferred embodiment, the layer 76 of silicon nitride in the dual-layer structure 78 will have a thickness of about 640–740 angstroms (about 700 angstroms=optimum).

Figure 6:
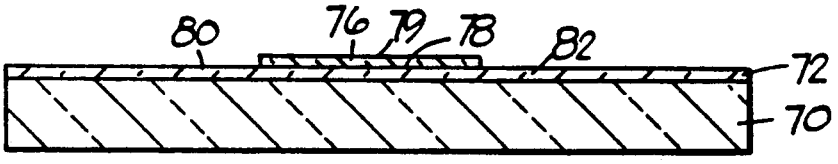

As shown in FIG. 6, the dual-layer structure 78 is then masked and etched using known, conventional processes to selectively remove portions of the layer 76 of silicon nitride in order to leave a single section 79 of silicon nitride as illustrated. In a preferred embodiment, etching is accomplished using standard plasma etching processes known in the art. Etching in this manner substantially reduces the overall size of the dual layer structure 78, and creates exposed regions 80, 82 of silicon dioxide adjacent thereto. At this point, it should be noted that the foregoing etching process removes some of the underlying layer 72 of silicon dioxide, reducing the thickness thereof at regions 80, 82 to about 150–200 angstroms.

Figure 7:
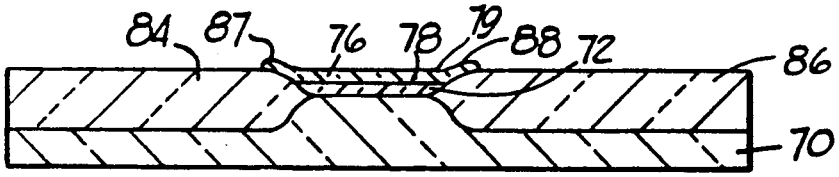

With reference to FIG. 7, the regions 80, 82 of silicon dioxide surrounding the structure 78 are used to produce a field oxide layer in the form of field oxide regions 84, 86 which are directly adjacent the dual layer structure 78, as illustrated. During this step, the layer 72 of silicon dioxide (and silicon substrate 70) beneath the layer 76 of silicon nitride are protected from further oxidation by the silicon nitride layer 76 which acts as a barrier to oxygen diffusion. Field oxide formation is accomplished in accordance with known processes as generally discussed in Appels, J. A. et al., *Philips Research Reports*, Vol. 26, No. 3, pp. 157–165 (June 1971); Kooi, E., et al., "Locos Devices," *Philips Research Reports*, Vol. 26, No. 3, pp. 166–180 (June 1971); and Elliott, D. J., suora. all of which are incorporated herein by reference. However, in a preferred embodiment, the field oxide regions 84, 86 are formed by heating the regions 80, 82 using the following sequential stages: 1) 950 degrees C. in an atmosphere of $N_2$+low $O_2$ for about 60.0 minutes; 2) 950 degrees C. in an atmosphere of $H_2+O_2$ for about 1100 minutes; 3) 950 degrees C. in an atmosphere of $N_2$ for about 20 minutes; 4) 1100 degrees C. in an atmosphere of $N_2$ for about 120 minutes; and 5) 900 degrees C. in an atmosphere of $N_2$ for about 20 minutes. This procedure (and other comparable field oxidation techniques) actually results in the diffusion of oxidizing gases through the previously-applied layer 72 of silicon dioxide at regions 80, 81 and oxidization of the underlying silicon in the substrate 70, thereby causing formation of the field oxide regions 84, 86. However, it should be noted that this procedure (along with the other etching, oxidizing, and layer formation techniques described herein) may be suitably varied within the scope of the present invention, and shall not be limited to any specific techniques. The preferred thickness of the resulting field oxide regions 84, 86 will be about 14,250–16,250 angstroms (about 15,250 angstroms=optimum). At this point, it should be noted that the field oxide regions 84, 86 form slightly beneath the ends 87, 88 of the layer 76 of silicon nitride, causing the ends 87, 88 to be urged slightly upward (FIG. 7).

Figure 8:
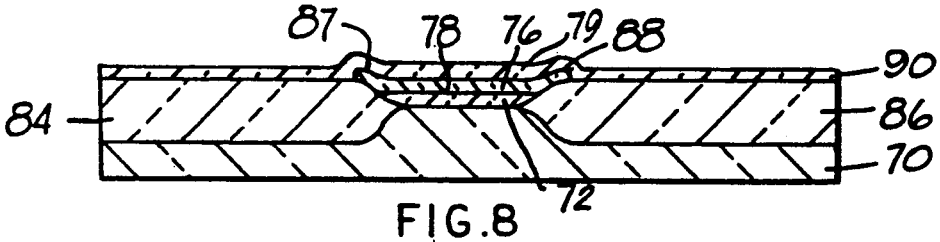

As shown in FIG. 8, a layer 90 of polycrystalline silicon is applied on top of the dual-layer structure 78 and on top of the field oxide regions 84, 86 as illustrated. Application of the layer 90 is typically accomplished by the LPCVD deposition of silicon resulting from the decomposition of a selected silicon-based composition (e.g. $HCl/SiH_4$ at about 618 degrees C.). The thickness of the layer 90 is about 3700–4300 angstroms (about 4000 angstroms = optimum).

Figure 9:
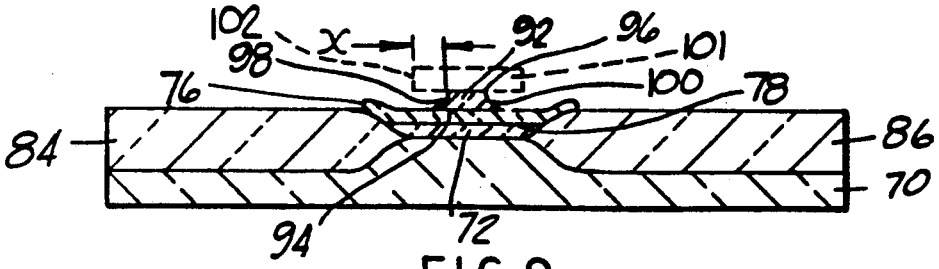

Next, the layer 90 of polycrystalline silicon is masked and etched to leave a polycrystalline silicon section 92 of reduced size on top of the layer 76 of silicon nitride (FIG. 9). The resulting section 92 of polycrystalline silicon has a lower surface 94 and an upper surface 96. In a preferred embodiment, the section 92 decreases continuously in width from the lower surface 94 to the upper surface 96 as illustrated. This decrease in width primarily occurs because of the progressively downward slope of the side walls 98, 100 of the section 92 which are formed intentionally during the etching process. To form the sloped side walls 98, 100 a selected isotropic etching process is used. Isotropic etching traditionally results in arcuate side wall structures which sweep outwardly from under the applied photoresist image (shown in dashed lines in FIG. 9 at reference number 101) and terminate at the etch stop layer (e.g. layer 76) in a downward arc. In a preferred embodiment, isotropic etching of the layer 90 of polycrystalline silicon occurs as a result of conventional plasma etching processes known in the art. Also, in a preferred embodiment, the distance "X" from the leading edge 102 of the resist image 101 to the upper surface 96 as illustrated in FIG. 9 is approximately 0.5 microns.

There are a number of benefits inherent in the sloped side walls 98, 100 of the section 92. Primarily, the sloped side walls 98, 100 are designed to create a larger, more gradually-angled surface for the deposition of subsequent layers thereon. Specifically, tests have shown that subsequent layers of material will more readily cover a sloped surface than a substantially vertical surface, thereby avoiding imperfections (e.g. gaps, delaminations, and the like) in the material layers. This is especially true with respect to silicon nitride, as discussed in greater detail below.

Figure 10:
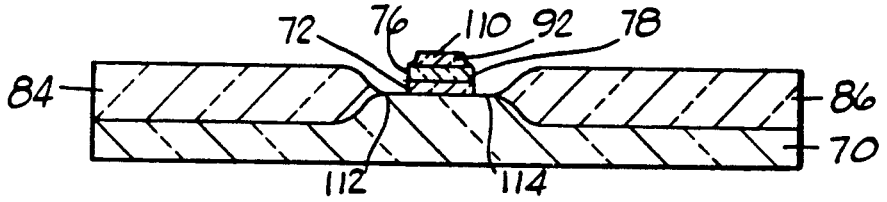

Next, with reference to FIG. 10, the dual-layer structure 78 is etched in order to produce the gate 110 shown in FIG. 10. Etching in this manner is accomplished using traditional plasma etching techniques known in the art. Etching results in the formation of exposed silicon regions 112, 114 between the gate 110 and the field oxide regions 84, 86.

Figure 11:
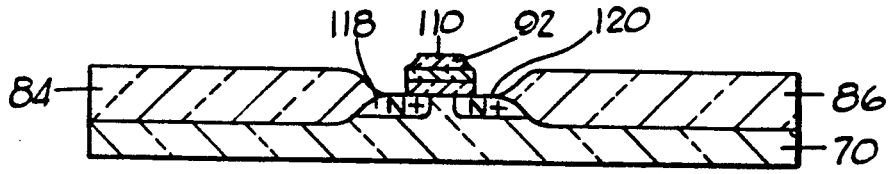

Upon completion of the gate 110, a phosphorous predeposition step is then undertaken in order to form the source and drain regions of the MOSFET transistor device. Phosphorous predeposition is conventionally accomplished by exposure of the silicon regions 112, 114 of FIG. 10 to a phosphorous-containing gas under controlled temperature conditions. For example, application of the following gases to the regions 112, 114 may be used to accomplish phosphorous predeposition: 1) $N_2$ for about 15 minutes; 2) $N_2+O_2$ for about 10 minutes; 3) $N_2+O_2+PH_3$ for about 20 minutes; and 4) $N_2$ for about 20 minutes. A preferred temperature of about 900 degrees C. is maintained during application of the above gases. As a result, source region 118 and drain region 120 are formed as illustrated in FIG. 11. Simultaneous with the formation of regions 118, 120, the polycrystalline silicon section 92 of the gate 110 is doped in a conventional manner with phosphorous, thereby dramatically increasing its electrical conductivity and resulting in a useful interconnection layer.

Next, a reoxidation layer of silicon dioxide (not shown) is formed over the gate 110, source region 118 and drain region 120. The reoxidation layer is designed to "repair" any damage to the foregoing layers caused by etching processes and the like. In a preferred embodiment, the reoxidation layer preferably has a thickness of about 1000 angstroms, and is formed using conventional thermal oxidation techniques. For example, application of the following gases may be applied to the structure of FIG. 11 to accomplish formation of the reoxidation layer: 1) $O_2$ for about 30 minutes; 2) $H_2+O_2$ for about 5 minutes; and 3) $N_2$ for about 30 minutes. A preferred temperature of about 850 degrees C. is maintained during application of the above gases.

Figure 12:
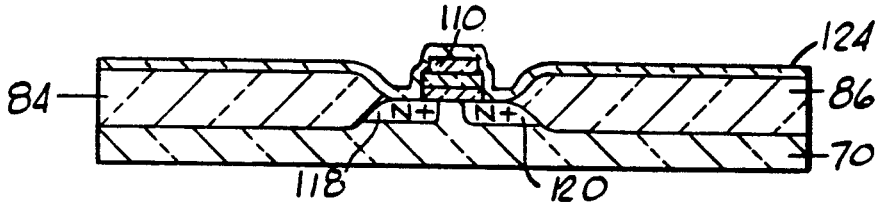

With reference to FIG. 12, a protective dielectric layer 124 is then applied onto the field oxide regions 84, 86 and onto the gate 110, source region 118, and drain region 120 (e.g. covering the reoxidation layer). The layer 124 may consist of 7% phosphorous doped silicon dioxide (5000–7000 angstroms thick; optimum = about 6000 angstroms) which is applied by conventional CVD processes. In an alternative embodiment, a layer of LPCVD-deposited silicon nitride may be used to form the protective layer 124 (about 1000–3000 angstroms; optimum = about 2000 angstroms). The use of silicon nitride offers numerous advantages compared with doped silicon dioxide. For example, the silicon nitride provides a harder, more durable surface for the deposition of subsequent material layers.

Figure 13:
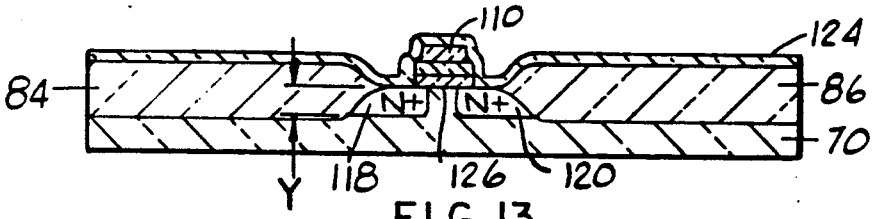

Finally, a source/drain junction drive step is initiated. In this step, the source region 118 and the drain region 120 are expanded inwardly into the substrate 70 in order to complete the formation thereof as shown in FIG. 13. This is accomplished in accordance with conventional processes wherein heat is applied in a controlled gaseous environment. For example, in a preferred embodiment, the junction drive step may be accomplished as shown in the following sequential steps: 1) heating at about 950 degrees C. for about 10 minutes in an $O_2$ environment; 2) heating at about 1000 degrees C. for about 10 minutes in an $H_2+O_2$ environment; and 3) heating at about 950 degrees C. for about 30 minutes in an $N_2$ environment.

In a preferred embodiment, this step will produce source and drain regions 118, 120 having a depth (e.g. thickness) "Y" (FIG. 13) of about 1.25–1.75 microns (about 1.5 microns = optimum). This configuration provides protection against junction spiking which may occur when tantalum-aluminum resistive materials and/or aluminum conductive layers are used in the printhead structure as described below.

During the foregoing heating process, the protective layer 124 (if made of doped silicon dioxide) will "reflow" around the gate 110, source region 118, and drain region 120. This process does not substantially occur if silicon nitride is used as the protective layer 124 since silicon nitride is much harder and more flow resistant than doped silicon dioxide. For this reason, the sloped side walls 98, 100 of the section 92 of polycrystalline silicon in the gate 110 are provided to ensure adequate and complete coverage of the gate 110 by the silicon nitride protective layer 124.

At this point, the completed MOSFET transistor 126 is shown in FIG. 13. By manufacturing the transistor 126 in the foregoing manner, a number of costly manufacturing steps are eliminated compared with previous production methods. This results in an overall increase in production efficiency. For example, in previous processes, the dual layer structure 78 having the layer 72 of silicon dioxide and layer 76 of silicon nitride therein (FIG. 7) is completely removed in a multi-step process after formation of the field oxide regions 84, 86. Thereafter, a separate layer of gate silicon dioxide is applied between the field oxide regions 84, 86. Thus, the process of the present invention eliminates the need to remove the dual layer structure 78 as noted above, and also eliminates the need to apply a separate, additional layer of silicon dioxide to the substrate 70. By leaving the dual layer structure 78 in place, a number of etching and deposition steps are eliminated. Likewise, by leaving the dual layer structure 78 in place, it can effectively function as gate dielectric in the transistor 126, thereby eliminating the need to apply a separate gate oxide layer. In this regard, the present invention allows the elimination of a number of expensive, time-consuming procedures which enables the rapid and efficient production of integrated thermal inkjet cartridges as described below.

Incorporation of the transistor 126 within a thermal inkjet printhead is schematically illustrated in FIGS. 14–19. However, before the remaining production steps are undertaken, any remaining extraneous layers of material (not shown) formed during the above processes must be removed from the backside 130 (FIG. 13) of the substrate 70. This may be accomplished using plasma etching processes known in the art.

Figure 14:
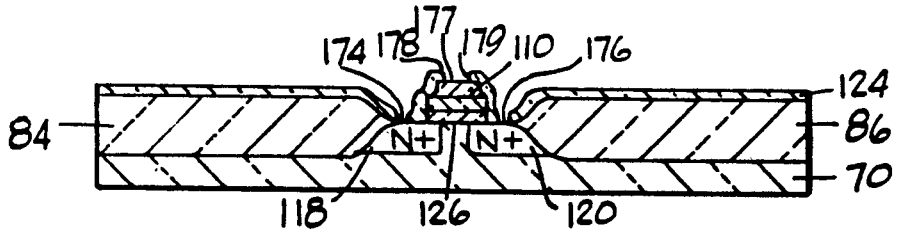

As shown in FIG. 14, the reoxidation layer (not shown) and protective layer 124 are conventionally etched away from a selected portion of the source region 118, the drain region 120, and the gate 110 using conventional etching processes. When the protective layer 124 consists of silicon dioxide, a two step process is employed which includes a wet etching stage using HF, followed by conventional plasma etching. In the alternative, if the layer 124 consists of silicon nitride, conventional plasma etching processes known in the art are used. Either of these processes creates openings 174, 176, 177 which provide access to the source region 118, drain region 120, and gate 110, respectively. It should also be noted that, using the foregoing process, sloped side walls 178, 179 surround each of the openings 174, 176, 177 as illustrated.

Figure 15:
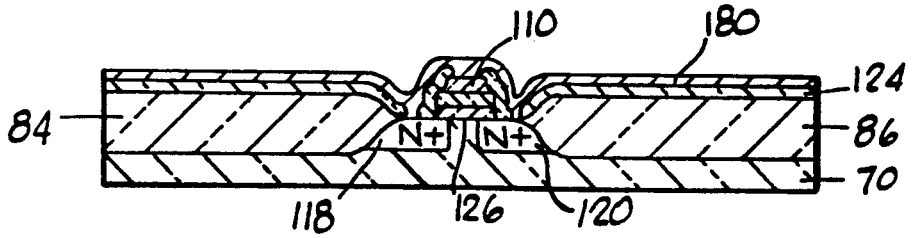

In a preferred embodiment, a layer 180 of electrically resistive material is then applied directly on top of the protective layer 124 (FIG. 15). In one embodiment, the resistive material used to form layer 180 is manufactured of a mixture of aluminum and tantalum. Likewise, tantalum nitride may be used, although the tantalum-aluminum mixture is preferred. This mixture is known in the art as a resistive material, and may be formed by the co-sputtering of both materials (as opposed to alloying of the materials, which involves a different process). Specifically, the final mixture basically consists of about 40–60 atomic (at.) % tantalum (about 50 at. %=optimum) and about 40–60 at. % aluminum (about 50 at. %=optimum). It is especially effective as an ohmic and metallurgically compatible contact material relative to the silicon compositions in the transistor 126.

In an alternative embodiment, the layer 180 may consist of phosphorous-doped polycrystalline silicon. This material is described in U.S. Pat. No. 4,513,298 to Scheu. The formation thereof is accomplished using oxide masking and diffusion techniques well known in the art and discussed in Elliott, D. J., suora. In addition to functioning as an effective resistor material, the polycrystalline silicon has a rough, yet uniform surface. This type of surface (which is readily repeatable during the manufacturing process) is ideal for the promotion of ink bubble nucleation thereon (e.g. bubble formation). In addition, polycrystalline silicon is highly stable at elevated temperatures, and avoids the oxidation problems characteristic of other resistive materials. The polycrystalline silicon is applied by the LPCVD deposition of silicon resulting from the decomposition of a selected silicon composition (e.g. silane) diluted by argon as discussed in U.S. Pat. No. 4,513,298. A typical temperature range for achieving this decomposition is about 600–650 degrees C., and a typical deposition rate is about one micron per minute.

In general, the layer 180 (if manufactured of, e.g., tantalum-aluminum) is applied at a uniform thickness of about 770–890 angstroms (about 830 angstroms=optimum). If polycrystalline silicon is used, the layer 180 is applied at a thickness of about 3000–5000 angstroms (4000 angstroms=optimum).

Figure 16:
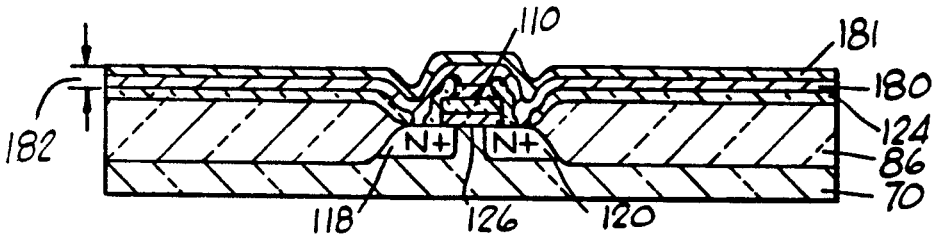

With reference to FIG. 16, a conductive layer 181 is then applied directly onto the layer 180 of resistive material to form a multi-layer structure 182. In a preferred embodiment, the conductive layer 181 may consist of aluminum, copper, or gold, with aluminum being preferred. In addition, the metals used to form the conductive layer 181 may be doped or combined with other materials, including copper and/or silicon. If aluminum is used, the copper is designed to control problems associated with electro-migration, while the silicon is designed to prevent side reactions between the aluminum and other silicon-containing layers in the system. An exemplary and preferred material used to produce the conductive layer 181 consists of about 95.5% by weight aluminum, about 3.0% by weight about 1.5% by weight silicon, although the present invention shall not be limited to the use of this specific composition. In general, the conductive layer 181 will have a uniform thickness of about 4000–6000 angstroms (about 5000 angstroms=optimum), and is applied using conventional sputtering or vapor deposition techniques.

Figure 17:
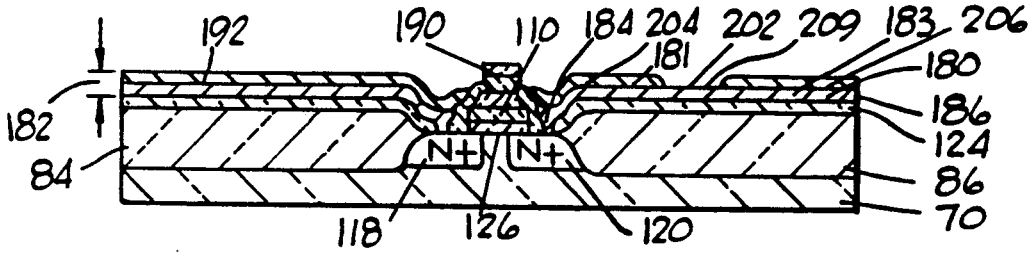

Thereafter, the multi-layer structure 182 is masked and etched (preferably using known plasma etching techniques) in order to divide the structure 182 into a variety of sections (FIG. 17). As illustrated in FIG. 17, the structure 182 now includes a first section 183 having a first end 184 and a second end 186. The first end 184 is in direct electrical/physical contact with drain region 120 of transistor 126 through opening 176 (FIGS. 14 and 15), with no intervening layers of material therebetween. This direct connection is an important and substantial departure from previously-designed systems.

Also included is a second section 190 which is positioned in direct electrical/physical contact with gate 110 of the transistor 126 through opening 177 (FIGS. 14 and 15), and is electrically separated from the first section 183. Furthermore, the structure 182 shown in FIG. 17 includes a third section 192 which electrically/physically communicates with the source region 118 of the transistor 126 through opening 174 (FIGS. 14–15). The ultimate functions of the first section 183, second section 190 and third section 192 will be described hereinafter.

As shown in FIG. 17, the conductive layer 181 of the structure 182 is subsequently masked and etched (e.g. plasma etched) in order to remove a portion thereof from the first section 183. As a result, the first section 183 is basically divided into an uncovered section 202 and covered sections 204, 206. The uncovered section 202 functions as a heating resistor 209 which ultimately causes ink bubble nucleation during cartridge operation. The covered section 204 serves as a direct conductive bridge between the resistor 209 and the drain region 120 of the transistor 126, and enables these components to electrically communicate with each other. Furthermore, this specific arrangement of layers provides a unique and substantial increase in production efficiency and economy.

From a technical standpoint, the presence of conductive layer 181 over the layer 180 of resistive material in the structure 182 defeats the ability of the resistive material (when covered) to generate significant amounts of heat. Specifically, the electrical current, flowing via the path of least resistance, will be confined to the conductive layer 181, thereby generating minimal thermal energy. Thus, the layer 180 only functions as a resistor at the uncovered section 202.

Figure 18:
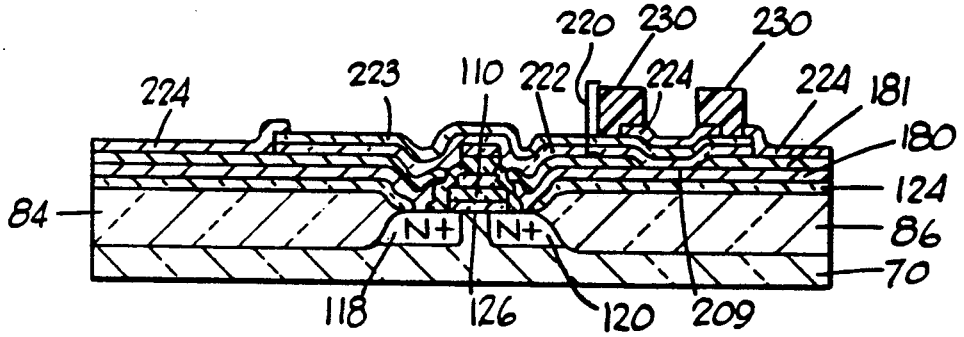

With reference to FIG. 18, a portion 220 of protective material is positioned on top of the underlying material layers, as described in greater detail below. The portion 220 of protective material may actually include four main layers in the present embodiment. Specifically, as shown in FIG. 18, a first passivation layer 222 is provided which preferably consists of silicon nitride. Layer 222 is applied by the PECVD of silicon nitride resulting from the decomposition of silane mixed with ammonia at a pressure of about 2 torr and temperature of about 300–400 degrees C. The layer 222 covers the resistor 209, and the transistor 126 as illustrated. The main function of the passivation layer 222 is to protect the resistor 209 (and the other components listed above) from the corrosive action of the ink used in the cartridge. This is especially important with respect to resistor 209, since any physical damage thereto can dramatically impair its basic operational capabilities. The passivation layer 222 preferably has a thickness of about 4000–6000 angstroms (about 5000 angstroms=optimum).

With continued reference to FIG. 18, the portion 220 of protective material also includes a second passivation layer 223 which is preferably manufactured of silicon carbide. In a preferred embodiment, the layer 223 is preferably formed by PECVD using silane and methane at a temperature of about 300–450 degrees C. The layer 223 covers the layer 222 as illustrated, and is again designed to protect the resistor 209 and other components listed above from corrosion damage.

Portion 220 of protective material further includes a conductive cavitation layer 224 which is selectively applied to various areas of the circuit as illustrated. However, the principal use of the cavitation layer 224 is over the portion of the second passivation layer 223 which covers the resistor 209 (FIG. 18). The purpose of the cavitation layer 224 is to eliminate or minimize damage to the resistor 209 and dielectric passivation films. In a preferred embodiment, the cavitation layer 224 consists of tantalum, although tungsten or molybdenum may also be used. The cavitation layer 224 is preferably applied by conventional sputtering techniques, and is normally about 5500–6500 angstroms thick (about 6000 angstroms=optimum).

Finally, as shown in FIG. 18, the portion 220 of protective material includes an ink barrier layer 230 selectively applied to and above the cavitation layer 224 and portions of the second passivation layer 223 on both sides of the resistor 209 as illustrated. The barrier layer 230 is preferably made of an organic polymer plastic which is substantially inert to the corrosive action of ink. Exemplary plastic polymers suitable for this purpose include products sold under the names VACREL and RISTON by E. I. DuPont de Nemours and Co. of Wilmington, Del. These products actually consist of polymethylmethacrylate, and are applied to the underlying material layers by conventional lamination techniques. In a preferred embodiment, the barrier layer 230 has a thickness of about 200,000–300,000 angstroms (about 254,000 angstroms=optimum). The materials listed above can withstand temperatures as high as 300 degrees C., and have good adhesive properties for holding the orifice plate of the printhead in position, as described below.

Figure 19:
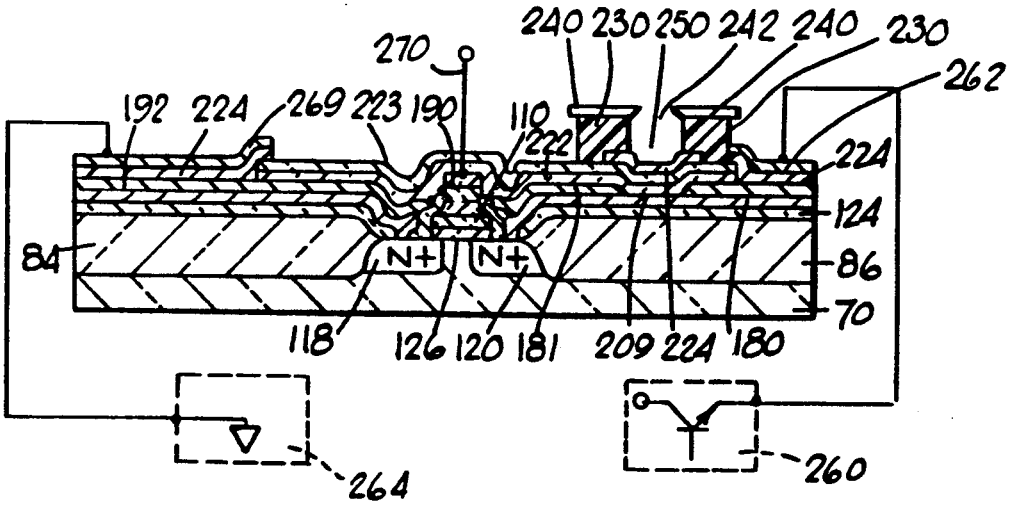

Finally, an orifice plate 240 known in the art is applied to the surface of the barrier layer 230 as shown in FIG. 19. The orifice plate 240 controls both drop volume and direction, and is preferably manufactured of nickel. It also includes a plurality of openings therein, each opening corresponding to at least one of the resistors in the system. The orifice plate 240 schematically illustrated in FIG. 19 includes an opening 242 which is directly above and aligned with the resistor 209. In addition, a section of the barrier layer 230 directly above the resistor 209 is removed or selectively applied in a conventional manner during the lamination/manufacturing process in order to form an opening or cavity 250 which is designed to receive ink from a source within the ink cartridge (e.g. a storage bladder unit or sponge-like member). Accordingly, activation of the resistor 209 imparts heat to the ink within the cavity 250 through layers 222, 223, 224, resulting in bubble nucleation.

The resistor 209 also electrically communicates with a conventional source 260 of drain voltage which is schematically illustrated in FIG. 19. Communication is accomplished via covered section 206 of structure 182 which is in direct physical contact with the conductive cavitation layer 224. Cavitation layer 224 communicates with an external contact layer 262 of conductive metal (e.g. gold) applied by sputtering at a thickness of about 4000–6000 angstroms (about 5000 angstroms=optimum). An identical configuration exists with respect to connection of the source region 118 of the transistor 126 to an external ground 264. Connection is accomplished via the third section 192 of the structure 182. The third section 192 electrically communicates with the ground 264 through cavitation layer 224 and an external contact layer 269 of the same type described above relative to layer 262. Finally, an external lead 270 is connected to gate 110 of the transistor 126 directly through passivation layers 222, 223 as illustrated. Lead 270 is specifically connected to the second section 190 of the structure 182.

The present invention as described herein represents an advance in MOSFET fabrication technology and thermal inkjet printhead design. Both the MOSFET transistor structure and thermal inkjet printhead of the present invention offer numerous and substantial benefits compared with other, more complex systems.

Having herein described preferred embodiments of the present invention, it is anticipated that suitable modifications may be made thereto by individuals skilled in the art within the scope of the invention. For example, the basic circuit fabrication and construction techniques referenced herein may be suitably varied as desired. Thus, the invention shall only be construed in accordance with the following claims:

We claim:

1. A thermal inkjet printhead structure having at least one MOSFET drive transistor integrated thereon comprising:

a substrate comprised of silicon;

a MOSFET transistor positioned on said substrate, said transistor comprising a source region, a drain region, and a gate positioned between said source region and said drain region, said gate comprising:

a layer of silicon dioxide on said substrate;

a layer of silicon nitride on said layer of silicon dioxide; and a layer of polycrystalline silicon on said layer of silicon nitride;

a field oxide layer on said substrate, said field oxide layer surrounding said transistor and being comprised of silicon dioxide;

a layer of dielectric material covering said field oxide layer and said transistor, said layer of dielectric material having a plurality of openings therethrough, said openings providing access to said source region, said drain region, and said gate of said transistor;

a layer of electrically resistive material positioned on said layer of dielectric material, said layer of electrically resistive material being in direct electrical contact with said source region, said drain region, and said gate through said openings;

a layer of conductive material affixed to a portion of said layer of electrically resistive material in order to form a multi-layer structure, said layer of electrically resistive material in said multi-layer structure having at least one uncovered section wherein said layer of conductive material is absent therefrom, said uncovered section functioning as a heating resistor, said layer of electrically resistive material being covered with said layer of conductive material at said source region, said drain region, and said gate of said transistor;

a portion of protective material positioned on said heating resistor; and a plate member having at least one opening therethrough, said plate member being secured to said portion of protective material, said portion of protective material having a section thereof removed directly beneath said opening through said plate member in order to form an ink receiving cavity thereunder, said heating resistor being positioned beneath and in alignment with said ink receiving cavity in order to impart heat thereto.

2. The printhead structure of claim 1 wherein said layer of electrically resistive material is comprised of a mixture of tantalum and aluminum.

3. The printhead structure of claim 1 wherein said layer of electrically resistive material is comprised of polycrystalline silicon.

4. The printhead structure of claim 1 wherein said layer of conductive material is comprised of a metal selected from the group consisting of aluminum, copper, and gold.

5. The printhead structure of claim 1 wherein said layer of polycrystalline silicon of said gate comprises an upper surface and a lower surface, said lower surface being adjacent said layer of silicon nitride, said layer of polycrystalline silicon continuously decreasing in width from said lower surface to said upper surface thereof.

6. The printhead structure of claim 1 wherein said layer of dielectric material is comprised of silicon nitride.

7. The printhead structure of claim 1 wherein said portion of protective material comprises:

a first passivation layer positioned on said resistor, said first passivation layer being comprised of silicon nitride;

a second passivation layer positioned on said first passivation layer, said second passivation layer being comprised of silicon carbide;

a cavitation layer positioned on said second passivation layer, said cavitation layer being comprised of a metal selected from the group consisting of tantalum, tungsten, and molybdenum; and an ink barrier layer positioned on said cavitation layer, said ink barrier layer being comprised of plastic, said plate member being secured to said ink barrier layer.

8. The printhead structure of claim 1 wherein said source region and said drain region of said transistor each have a thickness of about 1.25–1.75 microns.

9. A thermal inkjet printhead structure having at least one MOSFET drive transistor integrated thereon comprising:

a substrate comprised of silicon;

a MOSFET transistor substrate, said transistor comprising a source region, a drain region, and a gate positioned between said source region and said drain region, said gate comprising:

a layer of silicon dioxide on said substrate;

a layer of silicon nitride on said layer of silicon dioxide; and a layer of polycrystalline silicon on said layer of silicon nitride, said layer of polycrystalline silicon comprising an upper surface and a lower surface, said lower surface being adjacent said layer of silicon nitride, said layer of polycrystalline silicon continuously decreasing in width from said lower surface to said upper surface thereof;

a field oxide layer on said substrate, said field oxide layer surrounding said transistor and being comprised of silicon dioxide;

a layer of dielectric material comprised of silicon nitride covering said field oxide layer and said transistor, said layer of dielectric material having a plurality of openings therethrough, said openings providing access to said source region, said drain region, and said gate of said transistor;

a layer of electrically resistive material positioned on said layer of dielectric material, said layer of electrically resistive material being in direct electrical contact with said source region, said drain region, and said gate through said openings, said layer of electrically resistive material being comprised of a composition selected from the group consisting of polycrystalline silicon, and a mixture of tantalum and aluminum;

a layer of conductive material affixed to a portion of said layer of electrically resistive material in order to form a multi-layer structure, said layer of electrically resistive material in said multi-layer structure having at least one uncovered section wherein said layer of conductive material is absent therefrom, said uncovered section functioning as a heating resistor, said layer of electrically resistive material being covered with said layer of conductive material at said source region, said drain region, and said gate of said transistor, said layer of conductive material being comprised of a material selected from the group consisting of aluminum, copper and gold;

a first passivation layer positioned on said resistor, said first passivation layer being comprised of silicon nitride;

a second passivation layer positioned on said first passivation layer, said second passivation layer being comprised of silicon carbide;

a cavitation layer positioned on said second passivation layer, said cavitation layer being comprised of a metal selected from the group consisting of tantalum, tungsten, and molybdenum;

an ink barrier layer positioned on said cavitation layer, said ink barrier layer being comprised of plastic; and a plate member having at least one opening therethrough, said plate member being secured to said ink barrier layer, said ink barrier layer having a section thereof removed directly beneath said opening through said plate member in order to form an ink receiving cavity thereunder, said heating resistor being positioned beneath and in alignment with said ink receiving cavity in order to impart heat thereto.

10. The printhead structure of claim 9 wherein said source region and said drain region of said transistor each have a thickness of about 1.25–1.75 microns.

11. A thermal inkjet printing apparatus comprising:

a housing having at least one outlet therethrough;

storage means within said housing for retaining a supply of liquid ink therein; and a printhead secured to said housing, said printhead being in fluid communication with said storage means through said outlet and comprising:

a substrate comprised of silicon;

a MOSFET transistor positioned on said substrate, said transistor comprising a source region, a drain region, and a gate positioned between said source region and said drain region, said gate comprising:

a layer of silicon dioxide on said substrate;

a layer of silicon nitride on said layer of silicon dioxide; and a layer of polycrystalline silicon on said layer of silicon nitride;

a field oxide layer on said substrate, said field oxide layer surrounding said transistor and being comprised of silicon dioxide;

a layer of dielectric material covering said field oxide layer and said transistor, said layer of dielectric material having a plurality of openings therethrough, said openings providing access to said source region, said drain region, and said gate of said transistor;

a layer of electrically resistive material positioned on said layer of dielectric material, said layer of electrically resistive material being in direct electrical contact with said source region, said drain region, and said gate through said openings;

a layer of conductive material affixed to a portion of said layer of electrically resistive material in order to form a multi-layer structure, said layer of electrically resistive material in said multi-layer structure having at least one uncovered section wherein said layer of conductive material is absent therefrom, said uncovered section functioning as a heating resistor, said layer of electrically resistive material being covered with said layer of conductive material in said multi-layer structure at said source region, said drain region, and said gate of said transistor;

a portion of protective material positioned on said heating resistor; and a plate member having at least one opening therethrough, said plate member being secured to said portion of protective material, said portion of protective material having a section thereof removed directly beneath said opening through said plate member in order to form an ink receiving cavity thereunder, said heating resistor being positioned beneath and in alignment with said ink receiving cavity in order to impart heat thereto.

12. The printing apparatus of claim 11 wherein said layer of electrically resistive material is comprised of a mixture of tantalum and aluminum.

13. The printing apparatus of claim 11 wherein said layer of electrically resistive material is comprised of polycrystalline silicon.

14. The printing apparatus of claim 11 wherein said layer of conductive material is comprised of a metal selected from the group consisting of aluminum, copper, and gold.

15. The printing apparatus of claim 11 wherein said layer of polycrystalline silicon of said gate comprises an upper surface and a lower surface, said lower surface being adjacent said layer of silicon nitride, said layer of polycrystalline silicon continuously decreasing in width from said lower surface to said upper surface thereof.

16. The printing apparatus of claim 11 wherein said layer of dielectric material is comprised of silicon nitride.

17. The printing apparatus of claim 11 wherein said source region and said drain region of said transistor each have a thickness of about 1.25–1.75 microns.

18. The printing apparatus of claim 11 wherein said portion of protective material comprises:

a first passivation layer positioned on said resistor, said first passivation layer being comprised of silicon nitride;

a second passivation layer positioned on said first passivation layer, said second passivation layer being comprised of silicon carbide;

a cavitation layer positioned on said second passivation layer, said cavitation layer being comprised of a metal selected from the group consisting of tantalum, tungsten, and molybdenum; and an ink barrier layer positioned on said cavitation layer, said ink barrier layer being comprised of plastic, said plate member being secured to said ink barrier layer.

19. A thermal inkjet printing apparatus comprising:

a housing having at least one outlet therethrough;

storage means within said housing for retaining a supply of liquid ink therein; and a printhead secured to said housing, said printhead being in fluid communication with said storage means through said outlet and comprising:

a substrate comprised of silicon;

a MOSFET transistor positioned on said substrate, said transistor comprising a source region, a drain region, and a gate positioned between said source region and said drain region, said gate comprising:

a layer of silicon dioxide on said substrate;

a layer of silicon nitride on said layer of silicon dioxide; and a layer of polycrystalline silicon on said layer of silicon nitride, said layer of polycrystalline silicon comprising an upper surface and a lower surface, said lower surface being adjacent said layer of silicon nitride, said layer of polycrystalline silicon continuously decreasing in width from said lower surface to said upper surface thereof;

a field oxide layer on said substrate, said field oxide layer surrounding said transistor and being comprised of silicon dioxide;

a layer of dielectric material comprised of silicon nitride covering said field oxide layer and said transistor, said layer of dielectric material having a plurality of openings therethrough, said openings providing access to said source region, said drain region, and said gate of said transistor;

a layer of electrically resistive material positioned on said layer of dielectric material, said layer of electrically resistive material being in direct electrical contact with said source region, said drain region, and said gate through said openings, said layer of electrically resistive material being comprised of a composition selected from the group consisting of polycrystalline silicon, and a mixture of tantalum and aluminum;

a layer of conductive material affixed to a portion of said layer of electrically resistive material in order to form a multi-layer structure, said layer of electrically resistive material in said multi-layer structure having at least one uncovered section wherein said layer of conductive material is absent therefrom, said uncovered section functioning as a heating resistor, said layer of electrically resistive material being covered with said layer of conductive material at said source region, said drain region, and said gate of said transistor, said layer of conductive material being comprised of a material selected from the group consisting of aluminum, copper and gold;

a first passivation layer positioned on said resistor, said first passivation layer being comprised of silicon nitride;

a second passivation layer positioned on said first passivation layer, said second passivation layer being comprised of silicon carbide;

a cavitation layer positioned on said second passivation layer, said cavitation layer being comprised of a metal selected from the group consisting of tantalum, tungsten, and molybdenum;

an ink barrier layer positioned on said cavitation layer, said ink barrier layer being comprised of plastic; and a plate member having at least one opening therethrough, said plate member being secured to said ink barrier layer, said ink barrier layer having a section thereof removed directly beneath said opening through said plate member in order to form an ink receiving cavity thereunder, said heating resistor being positioned beneath and in alignment with said ink receiving cavity in order to impart heat thereto.

20. The printing apparatus of claim 19 wherein said source region and said drain region of said transistor each have a thickness of about 1.25–1.75 microns.

21. A method for manufacturing a thermal inkjet printhead structure having at least one MOSFET drive transistor integrated thereon comprising the steps of:

providing a substrate comprised of silicon;

forming a layer of silicon dioxide on said substrate;

forming a layer of silicon nitride on said layer of silicon nitride;

removing a portion of said layer of silicon nitride so as to leave a section of silicon nitride remaining intact on said layer of silicon dioxide, said section of silicon nitride being surrounded by a plurality of exposed regions of said layer of silicon dioxide;

oxidizing said substrate beneath said exposed regions of said layer of silicon dioxide in order to form a field oxide layer surrounding said section of silicon nitride;

forming a layer of polycrystalline silicon on said section of silicon nitride, said layer of polycrystalline silicon, said section of silicon nitride, and said layer of silicon dioxide thereunder together forming a gate of said transistor;

forming a transistor source region and a transistor drain region within said substrate adjacent said gate;

applying a layer of dielectric material onto said field oxide layer, said gate, said source region, and said drain region;

forming a plurality of openings through said layer of dielectric material in order to provide access to said gate, said source region, and said drain region;

applying a layer of electrically resistive material onto said layer of dielectric material, said layer of electrically resistive material being in direct electrical contact with said gate, said source region, and said drain region through said openings;

applying a layer of conductive material onto said layer of electrically resistive material in order to form a multi-layer structure, said layer of electrically resistive material in said multi-layer structure having at least one uncovered section wherein said layer of conductive material is absent therefrom, said uncovered section functioning as a heating resistor, said layer of electrically resistive material being covered with said layer of conductive material at said source region, said drain region, and said gate of said transistor;

applying a portion of protective material onto said resistor; and securing a plate member having at least one opening therethrough onto said portion of protective material, said portion of protective material having a section thereof removed directly beneath said opening through said plate member in order to form an ink receiving cavity thereunder, said heating resistor being positioned beneath and in alignment with said ink receiving cavity in order to impart heat thereto.

22. The method of claim 21 wherein said layer of polycrystalline silicon comprises an upper surface and a lower surface, said lower surface being adjacent said section of silicon nitride, said forming of said layer of polycrystalline silicon comprising the step of etching said polycrystalline silicon so that said layer of polycrystalline silicon continuously decreases in width from said lower surface to said upper surface thereof.

23. The method of claim 21 wherein said layer of electrically resistive material is comprised of a mixture of tantalum and aluminum.

24. The method of claim 21 wherein said layer of resistive material is comprised of polycrystalline silicon.

25. The method of claim 21 wherein said layer of conductive material is comprised of a metal selected from the group consisting of aluminum, copper, and gold.

26. The method of claim 21 wherein said applying of said portion of protective material comprises the steps of:

applying a first passivation layer comprised of silicon nitride onto said resistor;

applying a second passivation layer comprised of silicon carbide onto said first passivation layer;

applying a cavitation layer comprised of a metal selected from the group consisting of tantalum, tungsten, and molybdenum onto said second passivation layer; and applying an ink barrier layer comprised of plastic onto said cavitation layer, said plate member being secured to said ink barrier layer.

27. The method of claim 21 wherein said source region and said drain region of said transistor each have a thickness of about 1.25–1.75 microns.

28. A method for manufacturing a thermal inkjet printhead structure having at least one MOSFET drive transistor integrated thereon comprising the steps of:

providing a substrate comprised of silicon;

forming a layer of silicon dioxide on said substrate;

forming a layer of silicon nitride on said layer of silicon nitride;

removing a portion of said layer of silicon nitride so as to leave a section of silicon nitride remaining intact on said layer of silicon dioxide, said section of silicon nitride being surrounded by a plurality of exposed regions of said layer of silicon dioxide;

oxidizing said substrate beneath said exposed regions of said layer of silicon dioxide in order to form a field oxide layer surrounding said section of silicon nitride;

forming a layer of polycrystalline silicon on said section of silicon nitride, said layer of polycrystalline silicon comprising an upper surface and a lower surface, said lower surface being adjacent said section of silicon nitride, said forming of said layer of polycrystalline silicon further comprising the step of etching said polycrystalline silicon so that said layer of polycrystalline silicon continuously decreases in width from said lower surface to said upper surface thereof, said layer of polycrystalline silicon, said section of silicon nitride, and said layer of silicon dioxide thereunder together forming a gate in said transistor;

forming a transistor source region and a transistor drain region within said substrate adjacent said gate;

applying a layer of dielectric material onto said field oxide layer, said gate, said region, and said drain region;

forming a plurality of openings through said layer of dielectric material in order to provide access to said gate, said source region, and said drain region;

applying a layer of electrically resistive material onto said layer of dielectric material, said layer of electrically resistive material being in direct electrical contact with said gate, said source region, and said drain region through said openings, said layer of electrically resistive material being comprised of a composition selected from the group consisting of polycrystalline silicon, and a mixture of tantalum and aluminum;

applying a layer of conductive material onto said layer of electrically resistive material in order to form a multi-layer structure, said layer of electrically resistive material in said multi-layer structure having at least one uncovered section wherein said layer of conductive material is absent therefrom, said uncovered section functioning as a heating resistor, said layer of electrically resistive material being covered with said layer of conductive material at said source region, said drain region, and said gate of said transistor, said layer of conductive material being comprised of a composition selected from the group consisting of aluminum, copper, and gold;

applying a first passivation layer comprised of silicon nitride onto said resistor;

applying a second passivation layer comprised of silicon carbide onto said first passivation layer;

applying a cavitation layer comprised of a metal selected from the group consisting of tantalum, tungsten, and molybdenum onto said second passivation layer;

applying an ink barrier layer comprised of plastic onto said cavitation layer; and securing a plate member having at least one opening therethrough onto said ink barrier layer, said ink barrier layer having a section thereof removed directly beneath said opening through said plate member in order to form an ink receiving cavity thereunder, said heating resistor being positioned beneath and in alignment with said ink receiving cavity in order to impart heat thereto.

29. The method of claim 28 wherein said source region and said drain region of said transistor each have a thickness of about 1.25–1.75 microns.

30. A method for manufacturing a thermal inkjet printing apparatus comprising the steps of:

providing a substrate comprised of silicon;

forming a layer of silicon dioxide on said substrate;

forming a layer of silicon nitride on said layer of silicon nitride;

removing a portion of said layer of silicon nitride so as to leave a section of silicon nitride remaining intact on said layer of silicon dioxide, said section of silicon nitride being surrounded by a plurality of exposed regions of said layer of silicon dioxide;

oxidizing said substrate beneath said exposed regions of said layer of silicon dioxide in order to form a field oxide layer surrounding said section of silicon nitride;

forming a layer of polycrystalline silicon on said section of silicon nitride, said layer of polycrystalline silicon, said section of silicon nitride, and said layer of silicon dioxide thereunder together forming a gate of said transistor;

forming a transistor source region and a transistor drain region within said substrate adjacent said gate;

applying a layer of dielectric material onto said field oxide layer, said gate, said source region, and said drain region;

forming a plurality of openings through said layer of dielectric material in order to provide access to said gate, said source region, and said drain region;

applying a layer of electrically resistive material onto said layer of dielectric material, said layer of electrically resistive material being in direct electrical contact with said gate, said source region, and said drain region through said openings;

applying a layer of conductive material onto said layer of electrically resistive material in order to form a multi-layer structure, said layer of electrically resistive material in said multi-layer structure having at least one uncovered section wherein said layer of conductive material is absent therefrom, said uncovered section functioning as a heating resistor, said layer of electrically resistive material being covered with said layer of conductive material at said source region, said drain region, and said gate of said transistor;

applying a portion of protective material onto said resistor;

securing a plate member having at least one opening therethrough onto said portion of protective material, said portion of protective material having a section thereof removed directly beneath said opening through said plate member in order to form an ink receiving cavity thereunder, said heating resistor being positioned beneath and in alignment with said ink receiving cavity in order to impart heat thereto;

providing a housing having storage means therein for retaining a supply of liquid ink, said housing further comprising at least one outlet therethrough; and securing said substrate to said housing at a position thereon so that said ink receiving cavity is in fluid communication with said storage means through said outlet.

31. The method of claim 30 wherein said layer of electrically resistive material is comprised of a mixture of tantalum and aluminum.

32. The method of claim 30 wherein said layer of electrically resistive material is comprised of polycrystalline silicon.

33. The method of claim 30 wherein said layer of polycrystalline silicon comprises an upper surface and a lower surface, said lower surface being adjacent said section of silicon nitride, said forming of said layer of polycrystalline silicon comprising the step of etching said polycrystalline silicon so that said layer of polycrystalline silicon continuously decreases in width from said lower surface to said upper surface thereof.

34. The method of claim 30 wherein said applying of said portion of protective material comprises the steps of:

applying a first passivation layer comprised of silicon nitride onto said resistor;

applying a second passivation layer comprised of silicon carbide onto said first passivation layer;

applying a cavitation layer comprised of a metal selected from the group consisting of tantalum, tungsten, and molybdenum onto said second passivation layer; and applying an ink barrier layer comprised of plastic onto said cavitation layer, said plate member being secured to said ink barrier layer.

35. The method of claim 30 wherein said source region and said drain region of said transistor each have a thickness of about 1.25–1.75 microns.

36. A method for manufacturing a thermal inkjet printing apparatus comprising the steps of:

providing a substrate comprised of silicon;

forming a layer of silicon dioxide on said substrate;

forming a layer of silicon nitride on said layer of silicon nitride;

removing a portion of said layer of silicon nitride so as to leave a section of silicon nitride remaining intact on said layer of silicon dioxide, said section of silicon nitride being surrounded by a plurality of exposed regions of said layer of silicon dioxide;

oxidizing said substrate beneath said exposed regions of said layer of silicon dioxide in order to form a field oxide layer surrounding said section of silicon nitride;

forming a layer of polycrystalline silicon on said section of silicon nitride, said layer of polycrystalline silicon comprising an upper surface and a lower surface, said lower surface being adjacent said section of silicon nitride, said forming of said layer of polycrystalline silicon further comprising the step of etching said polycrystalline silicon so that said layer of polycrystalline silicon continuously decreases in width from said lower surface to said upper surface thereof, said layer of polycrystalline silicon, said section of silicon nitride, and said layer of silicon dioxide thereunder together forming a gate in said transistor;

forming a transistor source region and a transistor drain region within said substrate adjacent said gate;

applying a layer of dielectric material onto said field oxide layer, said gate, said source region, and said drain region;

forming a plurality of openings through said layer of dielectric material in order to provide access to said gate, said source region, and said drain region;

applying a layer of electrically resistive material onto said layer of dielectric material, said layer of electrically resistive material being in direct electrical contact with said gate, said source region, and said drain region through said openings, said layer of electrically resistive material being comprised of a composition selected from the group consisting of polycrystalline silicon, and a mixture of tantalum and aluminum;

applying a layer of conductive material onto said layer of electrically resistive material in order to form a multi-layer structure, said layer of electrically resistive material in said multi-layer structure having at least one uncovered section wherein said layer of conductive material is absent therefrom, said uncovered section functioning as a heating resistor, said layer of electrically resistive material being covered with said layer of conductive material at said source region, said drain region, and said gate of said transistor, said layer of conductive material being comprised of a composition selected from the group consisting of aluminum, copper, and gold;

applying a first passivation layer comprised of silicon nitride onto said resistor;

applying a second passivation layer comprised of silicon carbide onto said first passivation layer;

applying a cavitation layer comprised of a metal selected from the group consisting of tantalum, tungsten, and molybdenum onto said second passivation layer;

applying an ink barrier layer comprised of plastic onto said cavitation layer;

securing a plate member having at least one opening therethrough onto said ink barrier layer, said ink barrier layer having a section thereof removed directly beneath said opening through said plate member in order to form an ink receiving cavity thereunder, said heating resistor being positioned beneath and in alignment with said ink receiving cavity in order to impart heat thereto;

providing a housing having storage means therein for retaining a supply of liquid ink, said housing further comprising at least one outlet therethrough; and securing said substrate to said housing at a position thereon so that said ink receiving cavity is in fluid communication with said storage means through said outlet.

37. The method of claim 36 wherein said source region and said drain region of said transistor each have a thickness of about 1.25–1.75 microns.

* * * * *